US007316752B2

(12) United States Patent
Tomizawa et al.

(10) Patent No.: US 7,316,752 B2
(45) Date of Patent: Jan. 8, 2008

(54) R-T-B-C BASED RARE-EARTH MAGNETIC POWDER AND BONDED MAGNET

(75) Inventors: Hiroyuki Tomizawa, Hirakata (JP); Yuji Kaneko, Uji (JP)

(73) Assignee: Neomax Co., Ltd., Osaka (JP)

( * ) Notice: Subject to any disclaimer, the term of this patent is extended or adjusted under 35 U.S.C. 154(b) by 515 days.

(21) Appl. No.: 10/481,015

(22) PCT Filed: Jun. 29, 2001

(86) PCT No.: PCT/JP01/05688

§ 371 (c)(1),
(2), (4) Date: Dec. 17, 2003

(87) PCT Pub. No.: WO03/003386

PCT Pub. Date: Jan. 9, 2003

(65) Prior Publication Data

US 2004/0168747 A1 Sep. 2, 2004

(51) Int. Cl.
*H01F 1/053* (2006.01)
*H01F 1/057* (2006.01)

(52) U.S. Cl. ..... 148/301; 148/302; 148/101; 148/121; 420/83; 420/121

(58) Field of Classification Search ..... None
See application file for complete search history.

(56) References Cited

U.S. PATENT DOCUMENTS 6,706,124 B2 * 3/2004 Kanekiyo et al. ..... 148/302
2003/0052013 A1 * 3/2003 Ando et al. ..... 205/296

FOREIGN PATENT DOCUMENTS

| | | | |
|---|---|---|---|
| EP | 0 867 897 | | 9/1998 |
| JP | 02-071506 | | 3/1990 |
| JP | 04-268050 | | 9/1992 |
| JP | 04-268703 | | 9/1992 |
| JP | 04-269806 | | 9/1992 |
| JP | 05-105901 | | 4/1993 |
| JP | 06-124817 | | 5/1994 |
| JP | 06-124820 | * | 5/1994 |

(Continued)

*Primary Examiner*—John P Sheehan
(74) *Attorney, Agent, or Firm*—Nixon Peabody LLP; Jeffrey L. Costellia

(57) ABSTRACT

The step of preparing a rapidly solidified alloy by rapidly quenching a melt of an R-T-B-C based rare-earth alloy (where R is at least one of the rare-earth elements including Y, T is a transition metal including iron as its main ingredient, B is boron, and C is carbon) and the step of thermally treating and crystallizing the rapidly solidified alloy are included. The step of thermally treating results in producing a first compound phase with an $R_2Fe_{14}B$ type crystal structure and a second compound phase having a diffraction peak at a site with an interplanar spacing d of 0.295 nm to 0.300 nm (i.e., where 2θ=30 degrees). An intensity ratio of the diffraction peak of the second compound phase to that of $R_2Fe_{14}B$ type crystals representing a (410) plane is at least 10%. The present invention provides an R-T-B-C based rare-earth alloy magnetic material, including carbon (C) as an indispensable element but exhibiting excellent magnetic properties, and makes it possible to recycle rare-earth magnets.

16 Claims, 9 Drawing Sheets

FOREIGN PATENT DOCUMENTS

| | | |
|---|---|---|
| JP | 06-124821 | 5/1994 |
| JP | 07-078706 | 3/1995 |
| JP | 10-324962 | 12/1998 |
| JP | 2001-118710 | 4/2001 |
| JP | 2001-143916 | 5/2001 |

* cited by examiner

R-T-B-C BASED RARE-EARTH MAGNETIC POWDER AND BONDED MAGNET

TECHNICAL FIELD

The present invention relates to a rare-earth magnetic powder that can be used effectively to make a bonded magnet and to a bonded magnet made of such a magnetic powder. More particularly, the present invention relates to an R-T-B-C based rare-earth magnet in which carbon (C) is substituted for a portion of boron (B).

BACKGROUND ART

Currently, R-T-B based (where R is at least one of the rare-earth elements including Y, T is a transition metal including iron as its main ingredient, and B is boron) rare-earth magnets are extensively used as high-performance magnets in a broad variety of applications. In order to not just save, or at least use more efficiently, valuable natural resources but also cut down the manufacturing cost of the R-T-B based rare-earth magnets, it is important to make those R-T-B based rare-earth magnets recyclable.

The grinding sludge and fine powder, which are produced during the manufacturing process of R-T-B based sintered magnets, are oxidizable so easily as to possibly ignite spontaneously within the air atmosphere. Accordingly, the sludge and fine powder are normally oxidized intentionally by incineration or any other suitable process so as to turn into chemically stabilized oxides. If those oxides are subjected to a chemical process such as acid dissolution, the rare-earth components thereof can be separated and extracted.

Meanwhile, techniques of recycling final R-T-B based magnet products into the R-T-B based material alloy by re-melting or any other process are also under research and development.

However, if the R-T-B based rare-earth magnets are re-melted, then oxygen can be sufficiently removed from the rare-earth magnets but the carbon content thereof rather increases. Other problems may also be caused by the re-melting technique.

It has been generally believed that to improve the magnet performance and anticorrosiveness of R-T-B based rare-earth magnets, impurities such as oxygen and carbon should be eliminated from the magnets as much as possible. According to this point of view, the technique of removing those impurities is a key to making the R-T-B based rare-earth magnets recyclable more easily and more effectively.

However, if a special process is required to remove oxygen and carbon, then the manufacturing cost will rise significantly and cannot be reduced effectively. This constitutes a serious obstacle to recycling the rare-earth magnets successfully.

In attempting to recycle a rare-earth bonded magnet on the other hand, the bonded magnet may be separated into a magnetic powder and a binder resin, and then only the magnetic powder may be subjected to a recycling process. According to this technique, however, such a resin includes too much carbon component to prevent the carbon in the resin from depositing or sticking onto the magnetic powder. Thus, the magnetic powder collected from the bonded magnet should include a lot of carbon and other impurities. For that reason, the bonded magnets, as well as the rare-earth sintered magnets, also require a special carbon removal process, thus making the rare-earth bonded magnets non-recyclable.

In order to overcome the problems described above, a primary object of the present invention is to provide an R-T-B-C based rare-earth alloy magnetic material, which includes carbon (C) as an indispensable element but can still exhibit excellent magnetic properties, while making rare-earth magnets recyclable.

DISCLOSURE OF INVENTION

An R-T-B-C based rare-earth alloy magnetic material according to the present invention (where R is at least one of the rare-earth elements including Y, T is a transition metal including iron as its main ingredient, B is boron, and C is carbon) includes a first compound phase with an $R_2Fe_{14}B$ type crystal structure and a second compound phase having a diffraction peak at a site with an interplanar spacing d of 0.295 nm to 0.300 nm. An intensity ratio of the diffraction peak of the second compound phase to that of the first compound phase representing a (410) plane (and having an interplanar spacing of 0.214 nm) is at least 10%.

In one preferred embodiment, the mole fraction of R is 25 wt % to 35 wt % of the overall magnetic material, the total mole fraction of B and C is 0.9 wt % to 1.1 wt % of the magnetic material, and the balance of the magnetic material is T.

In another preferred embodiment, the ratio of the content of C (carbon) to the total content of B (boron) and C is 0.05 to 0.75.

The first compound phase preferably has an average grain size of 10 nm to 500 nm.

In another preferred embodiment, the R-T-B-C based rare-earth alloy magnetic material is obtained by a method including the steps of: making a rapidly solidified alloy by rapidly quenching a melt of the R-T-B-C based rare-earth alloy; and thermally treating and crystallizing the rapidly solidified alloy.

T preferably includes Fe as its main ingredient but a portion of Fe may be replaced with at least one element selected from the group consisting of Co, Ni, Mn, Cr and Al.

The R-T-B-C based rare-earth alloy magnetic material may further include, as an additive, at least one element selected from the group consisting of Si, P, Cu, Sn, Ti, Zr, V, Nb, Mo and Ga.

A rare-earth alloy magnetic powder according to the present invention is obtained by pulverizing any of the R-T-B-C based rare-earth alloy magnetic materials described above.

A bonded magnet according to the present invention is produced by processing the rare-earth alloy magnetic powder described above.

A permanent magnet according to the present invention is produced by processing the rare-earth alloy magnetic powder described above.

An inventive method of making an R-T-B-C based rare-earth alloy magnetic material includes the steps of: preparing a rapidly solidified alloy by rapidly quenching a melt of an R-T-B-C based rare-earth alloy (where R is at least one of the rare-earth elements including Y, T is a transition metal including iron as its main ingredient, B is boron, and C is carbon); and thermally treating and crystallizing the rapidly solidified alloy. The step of thermally treating results in producing a first compound phase with an $R_2Fe_{14}B$ type crystal structure and a second compound phase having a diffraction peak at a site with an interplanar spacing d of 0.295 nm to 0.300 nm. An intensity ratio of the diffraction peak of the second compound phase to that of the first compound phase representing a (410) plane is at least 10%.

Another inventive method of making an R-T-B-C based rare-earth alloy magnetic material includes the step of obtaining the R-T-B-C based rare-earth alloy magnetic material, including a first compound phase with an $R_2Fe_{14}B$ type crystal structure and a second compound phase having a diffraction peak at a site with an interplanar spacing d of 0.295 nm to 0.300 nm, by rapidly quenching a melt of an R-T-B-C based rare-earth alloy (where R is at least one of the rare-earth elements including Y, T is a transition metal including iron as its main ingredient, B is boron, and C is carbon). An intensity ratio of the diffraction peak of the second compound phase to that of the first compound phase representing a (410) plane is at least 10%.

A pulverizing process step is preferably performed before and/or after the step of thermally treating.

An inventive method for producing a bonded magnet includes the steps of: preparing a powder of the R-T-B-C based rare-earth alloy magnetic material that has been obtained by one of the methods described above; and compounding the powder and a binder material together and molding the compound.

Still another inventive method of making an R-T-B-C based rare-earth alloy magnetic material includes the steps of: preparing an R-T-B-C based rare-earth rapidly solidified alloy (where R is at least one of the rare-earth elements including Y, T is a transition metal including iron as its main ingredient, B is boron, and C is carbon) by melting and rapidly quenching and solidifying a collected and used R-T-B based rare-earth magnet; and thermally treating and crystallizing the R-T-B-C based rare-earth rapidly solidified alloy.

In one preferred embodiment, the step of thermally treating results in producing a first compound phase with an $R_2Fe_{14}B$ type crystal structure and a second compound phase having a diffraction peak at a site with an interplanar spacing d of 0.295 nm to 0.300 nm, and an intensity ratio of the diffraction peak of the second compound phase to that of the first compound phase representing a (410) plane is at least 10%.

An inventive method for producing a bonded magnet includes the steps of: preparing a powder of the R-T-B-C based rare-earth alloy magnetic material that has been obtained by one of the methods described above; and compounding the powder and a binder material together and molding the compound.

BRIEF DESCRIPTION OF DRAWINGS

FIG. 1(*b*) shows, on a larger scale, a portion of the machine to rapidly quench and solidify the alloy.

BEST MODE FOR CARRYING OUT THE INVENTION

Figure 1A:
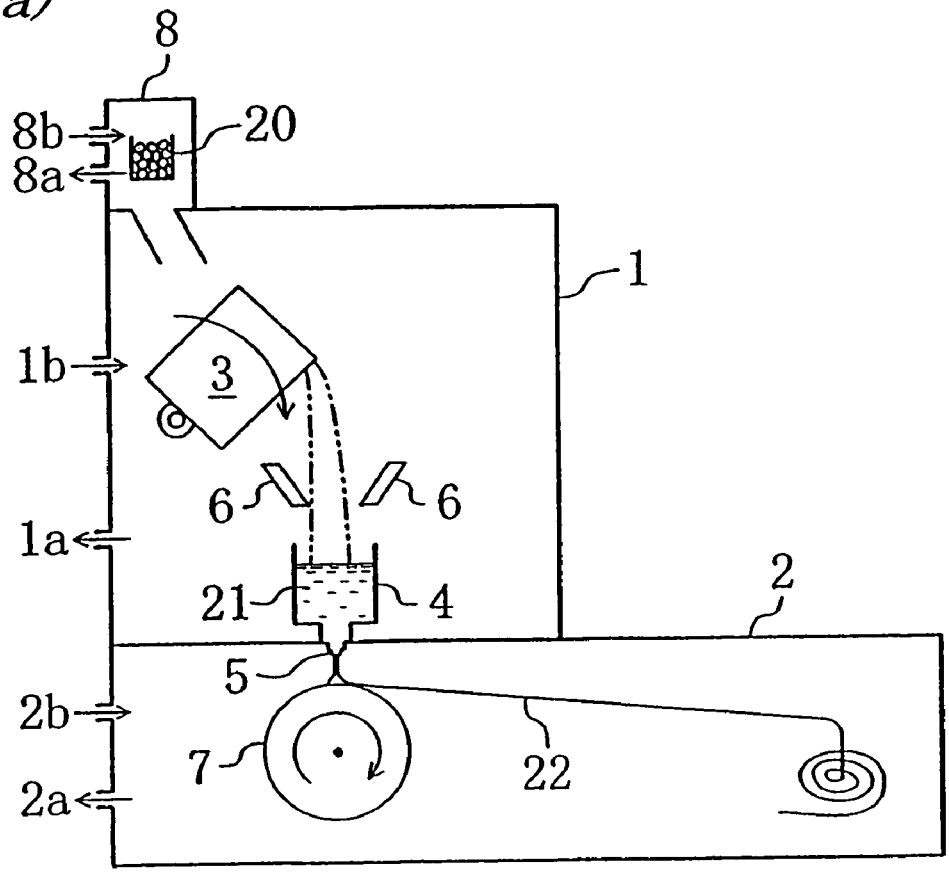
FIG. 1(*a*) is a cross-sectional view illustrating an overall configuration for an ultra rapid quenching machine for use in a method of making an R-T-B-C based rare-earth alloy magnetic material according to the present invention.

The present inventors analyzed an R-T-B based rare-earth magnetic material, including carbon (C) as its indispensable component, from various angles. As a result, the present inventors discovered that if a molten alloy satisfying a certain composition range was solidified by a rapid quenching process and then thermally treated in an appropriate temperature range, not only an $R_2Fe_{14}B$ type compound with hard magnetic properties but also a previously unknown compound crystalline phase, having a diffraction peak at a site with an interplanar spacing d of 0.295 nm to 0.300 nm (e.g., around d=0.298 nm), were produced. The present inventors acquired the basic idea of the present invention from this discovery.

However, if the amount of carbon in the alloy, the composition range of any other component, or the condition of the heat treatment process for crystallization is changed, then the compound crystalline phase, having a diffraction peak at a site with an interplanar spacing d of 0.295 nm to 0.300 nm (when CuKα is used as an X-ray source, around 2θ=30 degrees) is no longer produced at a detectible level. Such a compound crystalline phase will be referred to herein as a "second compound phase" for convenience sake. The crystal structure of this second compound phase has not yet been elucidated so far, but may well be regarded as playing an important role in improving magnetic properties.

The present inventors discovered and confirmed via experiments that if the second compound phase was produced with the amount of carbon in the alloy, the composition ranges of other components and the conditions of the heat treatment process for crystallization adjusted appropriately and if the intensity ratio of the diffraction peak of the second compound phase to that of the $R_2Fe_{14}B$ type compound phase representing a (410) plane (and having an interplanar spacing of 0.214 nm) was at least 10%, sufficiently good magnetic properties were achieved in practice.

In order to achieve even better magnetic properties, this peak intensity ratio is preferably 30% or more, and even more preferably 50% or more.

R-T-B-C based rare-earth alloy magnetic materials, to which carbon (C) is added intentionally, have already been reported. However, the second compound phase having such a diffraction peak has never been observed. The reason is believed to be as follows. Specifically, the second compound phase being produced is sensible to the composition of the material alloy or the heat treatment condition. Accordingly, if the rare-earth alloy magnetic material is made under normal conditions, then no second compound phase having such a diffraction peak will be produced. Or even if that compound phase is produced, its amount will be very small.

According to the present invention, the second compound is produced by adding an appropriate amount of carbon to the material alloy such that carbon substitutes for a portion of boron in the alloy. Then, the magnetic properties such as the remanence thereof improve and the weather resistance thereof increases.

In this manner, according to the present invention, the carbon component, which has been treated as an impurity, can be incorporated as an indispensable component. Thus, the present invention is applicable for use in recycling an R-T-B based sintered magnet or an R-T-B based bonded magnet. That is to say, a material alloy including carbon component can be obtained from the used and collected R-T-B based sintered or bonded magnet, and then efficiently processed into an R-T-B-C based rare-earth alloy magnetic material according to the present invention. A bonded magnet, in particular, normally uses a resin as a binder to bond magnetic powder particles together as described above. Thus, a carbon based substance often sticks strongly to the surface of the magnet. However, even such a magnet can also be used effectively as a material according to the present invention.

It should be noted that the present inventors confirmed that the magnetic material of the present invention exhibited not only excellent magnetic properties but also good quality in weather resistance, for example.

According to the present invention, the total amount of boron and carbon (i.e., (B+C)) is preferably 0.9 wt % to 1.1 wt %, while the carbon ratio (i.e., C/(B+C)) is preferably 0.05 to 0.75.

Optionally, a portion of Fe included in the material of the present invention may be replaced with at least one element selected from the group consisting of Co, Ni, Mn, Cr and Al. Also, at least one element selected from the group consisting of Si, P, Cu, Sn, Ti, Zr, V, Nb, Mo and Ga may be added thereto.

Hereinafter, preferred embodiments of the present invention will be described.

Melt-Quenching Machine

Figure 1B:
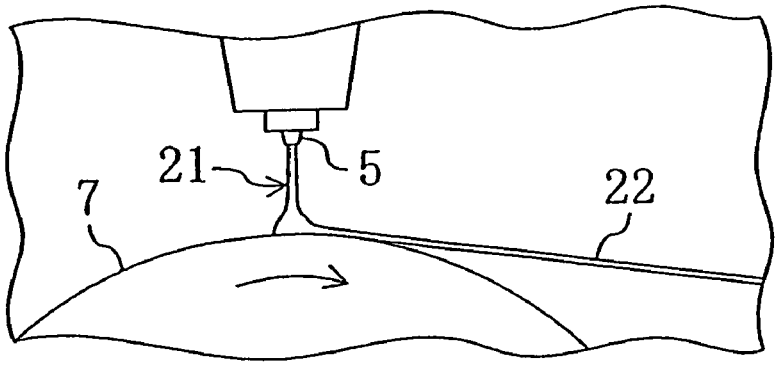

The machine shown in FIG. 1(*a*) includes a material alloy melting chamber 1 and a material alloy quenching chamber 2, in which a vacuum or an inert atmosphere is maintained at an adjustable pressure. Specifically, FIG. 1(*a*) illustrates an overall arrangement of the machine, while FIG. 1(*b*) illustrates a portion of the machine on a larger scale.

As shown in FIG. 1(*a*), the melting chamber 1 includes: a melt crucible 3 to melt, at an elevated temperature, a material 20 that has been mixed to have a desired magnet alloy composition; a reservoir 4 with a teeming nozzle 5 at the bottom; and a mixed material feeder 8 to supply the mixed material into the melt crucible 3 while maintaining an airtight condition. The reservoir 4 stores the melt 21 of the material alloy therein and is provided with a heater (not shown) to maintain the temperature of the melt teemed therefrom at a predetermined level.

The quenching chamber 2 includes a rotating chill roller 7 for rapidly quenching and solidifying the melt 21 that has been ejected through the teeming nozzle 5.

In this machine, the atmosphere and pressure inside of the melting and quenching chambers 1 and 2 are controllable within prescribed ranges. For that purpose, atmospheric gas inlet ports 1*b*, 2*b* and 8*b* and outlet ports 1*a*, 2*a* and 8*a* are provided at appropriate positions of the machine. In particular, the gas outlet port 2*a* is connected to a pump to control the absolute pressure in the quenching chamber 2 within a range of vacuum to 80 kPa.

The melt crucible 3 may define a desired tilt angle to pour the melt 21 through a funnel 6 into the reservoir 4. The melt 21 is heated in the reservoir 4 by the heater (not shown).

The teeming nozzle 5 of the reservoir 4 is positioned on the boundary wall between the melting and quenching chambers 1 and 2 to drip the melt 21 from the reservoir 4 onto the surface of the chill roller 7, which is located under the nozzle 5. The orifice diameter of the teeming nozzle 5 may be 0.5 mm to 2.0 mm, for example. If the viscosity of the melt 21 is high, then the melt 21 cannot flow through the teeming nozzle 5 easily. In this embodiment, however, the pressure in the quenching chamber 2 is kept lower than the pressure in the melting chamber 1. Accordingly, an appropriate pressure difference is created between the melting and quenching chambers 1 and 2, and the melt 21 can be teemed smoothly. In addition, since the material alloy of the present invention includes carbon, the molten alloy has so low viscosity as to drip constantly enough.

The chill roller 7 is preferably made of Cu, Fe or an alloy including Cu or Fe. This is because if the chill roller is made of a material other than Cu or Fe, the resultant rapidly solidified alloy cannot leave the chill roller easily and might wind around the roller. The chill roller 7 may have a diameter of 300 mm to 500 mm, for instance. The water-cooling capability of a water cooler provided inside of the chill roller 7 is calculated and adjusted based on the latent heat of solidification and the volume of the melt teemed per unit time.

The machine shown in FIGS. 1(*a*) and 1(*b*) can rapidly solidify 10 kg of material alloy in 10 to 20 minutes, for example. The rapidly solidified alloy obtained in this manner is in the form of an alloy thin strip (or alloy ribbon) 22 with a thickness of 10 μm to 300 μm and a width of 2 mm to 3 mm, for example.

Melt-Quenching Process

First, the melt 21 of the material alloy, having the composition described above, is prepared and stored in the reservoir 4 of the melting chamber 1 shown in FIG. 1(*a*). In this preferred embodiment, carbon is introduced into the material alloy by adding ferrocarbon thereto. The material alloy may also be obtained from collected and used rare-earth sintered magnets or bonded magnets.

Next, the melt 21 is dripped through the teeming nozzle 5 onto the water-cooled roller 7 to contact with, and be rapidly cooled and solidified by, the chill roller 7 within a low-pressure Ar atmosphere. In this case, an appropriate rapid solidification technique, making the cooling rate controllable precisely, is preferably adopted. In this embodiment, the melt 21 is preferably cooled at a rate of $10^{2}$° C./s to $10^{7}$° C./s.

A period of time during which the melt 21 is quenched by the chill roller 7 is equivalent to an interval between a point in time the alloy contacted with the outer circumference of the rotating chill roller 7 and a point in time the alloy leaves the roller 7. In this period of time, the alloy has its temperature decreased to be solidified. Thereafter, the solidified alloy leaves the chill roller 7 and travels within the inert atmosphere. While the thin-strip alloy is traveling, the alloy has its heat dissipated into the atmospheric gas. As a result, the temperature of the alloy further drops.

In this preferred embodiment, a rapidly solidified alloy including amorphous phases is obtained by controlling the roller surface velocity within the range of 5 m/s to 50 m/s. The reasons are as follows. Specifically, if the roller surface velocity is less than 5 m/s, then crystalline phases with excessively large sizes nucleate and grow and the desired microcrystalline structure cannot be formed. However, a roller surface velocity exceeding 50 m/s is normally hard to realize by mass producible equipment. Also, even if such a high roller surface velocity could be realized, the magnetic properties should not improve so dramatically. The roller surface velocity is more preferably 20 m/s to 50 m/s.

In the present invention, the technique of rapidly quenching the melt is not limited to the single roller melt-spinning method described above. Examples of other applicable techniques include a twin roller method, a gas atomization method, a strip casting method, and a rapid quenching technique utilizing the roller and gas atomization methods in combination.

According to the present invention, the material alloy includes carbon, and therefore amorphous phases can be created more efficiently. Thus, even though the cooling rate is relatively low, a rapidly solidified alloy including a lot of amorphous phases can still be produced with high reproducibility. For that reason, a magnetic alloy with excellent magnetic properties can be obtained even by a strip casting process, which ensures high mass productivity but a relatively low cooling rate among various rapid quenching techniques mentioned above.

Heat Treatment

In this preferred embodiment, the heat treatment is conducted within an argon atmosphere. Preferably, the alloy is heated at a temperature rise rate of 5° C./s to 200° C./s, maintained at a temperature of 550° C. to 750° C. for an amount of time of 30 seconds to 60 minutes, and then cooled to room temperature. This heat treatment results in crystal growth of the $R_2Fe_{14}B$ crystalline phase and second compound phase in the amorphous phases.

If the heat treatment temperature is lower than 550° C., then no $R_2Fe_{14}B$ type crystalline phases will nucleate and the coercivity will be unnoticeably low. On the other hand, if the heat treatment temperature exceeds 750° C., the grain growth of the respective constituent phases will advance too much, thus decreasing the remanence $B_r$ and deteriorating the loop squareness of the demagnetization curve. For these reasons, the heat treatment temperature is preferably 550° C. to 750° C., more preferably 550° C. to 700° C.

To prevent the alloy from being oxidized, the heat treatment is preferably conducted within an inert gas (e.g., Ar or $N_2$ gas) atmosphere at a pressure of 50 kPa or less. The heat treatment may also be performed within a vacuum of 0.1 kPa or less.

It should be noted that the thin strip of the rapidly solidified alloy may be coarsely cut or pulverized before subjected to the heat treatment.

After thermally treated, the resultant magnetic material is finely pulverized to obtain a magnet powder. Then, various types of bonded magnets can be made from this powder by performing known process steps on this powder. In making a bonded magnet, the magnet powder of the present invention is compounded with an epoxy or nylon resin binder and then the compound is molded into a desired shape. In this case, a magnet powder of any other type (e.g., an Sm-T-N based magnet powder or hard ferrite magnet powder) may be mixed with the magnet powder of the present invention.

Using the resultant bonded magnet, motors, actuators and other rotating machines can be produced.

If the magnet powder is used to make an injection-molded bonded magnet, the powder is preferably pulverized to a mean particle size of 150 μm or less, more preferably 1 μm to 100 μm. On the other hand, if the magnet powder is used to make a compressed bonded magnet, the powder is preferably pulverized to a mean particle size of 300 μm or less, more preferably 50 μm to 200 μm, and even more preferably 50 μm to 150 μm with a bimodal size distribution.

EXAMPLES

First, mother alloys having the respective compositions shown in the following Table 1 were prepared by an induction melting process. A raw material with a purity of 99.5% or more was used for Nd, ferrocarbon including 3.0 mass % of carbon was used for carbon, and a raw material with a purity of 99.9% or more was used for each of the other components. The material alloy was melted in an alumina crucible within an Ar atmosphere.

TABLE 1 wt %

| Sign | Nd | Fe | Co | B | C | M1 | M2 |
|---|---|---|---|---|---|---|---|
| A | 25.0 | 74.2 | 0.0 | 0.40 | 0.40 | | |
| B | 27.0 | 72.1 | 0.0 | 0.45 | 0.45 | | |
| C | 27.0 | 71.8 | 0.0 | 0.60 | 0.60 | | |
| D | 28.0 | 71.1 | 0.0 | 0.55 | 0.35 | | |
| E | 30.0 | 69.0 | 0.0 | 1.00 | 0.00 | | |
| F | 30.0 | 69.0 | 0.0 | 0.75 | 0.25 | | |
| G | 30.0 | 69.0 | 0.0 | 0.50 | 0.50 | | |
| H | 30.0 | 69.0 | 0.0 | 0.75 | 0.25 | | |
| I | 30.0 | 69.0 | 0.0 | 0.00 | 1.00 | | |
| J | 30.0 | 68.6 | 0.0 | 0.75 | 0.25 | Al: 0.40 | |
| K | 30.0 | 68.2 | 0.0 | 0.75 | 0.25 | Al: 0.50 | Cu: 0.30 |
| L | 30.0 | 63.5 | 5.0 | 0.75 | 0.25 | Ga: 0.50 | |
| M | 30.0 | 63.2 | 5.0 | 0.75 | 0.25 | Mo: 0.80 | |
| N | 30.0 | 58.4 | 10.0 | 0.50 | 0.50 | Cr: 0.30 | Al: 0.30 |
| O | 35.0 | 63.8 | 0.0 | 0.60 | 0.60 | | |

No carbon (C) was added to mother alloy E. In mother alloy I, boron (B) was entirely replaced with carbon (C). The content of Nd in mother alloy A was 25 wt %, which was the smallest among the mother alloys shown in Table 1. On the other hand, the content of Nd in mother alloy O was 35 wt %, which was larger than any other mother alloy shown in Table 1.

The melt of each of these mother alloys A through O was rapidly cooled and solidified by a single roller process, thereby obtaining a thin strip of rapidly solidified alloy. A chill roller for use in the rapid quenching process was made of Cu, and was rotated at a peripheral velocity of 35 m/s. The mother alloy was melted in a quartz tube having an orifice with a diameter of 0.7 mm. The distance (or the gap) between the end of the orifice of the quartz tube and the roller surface was defined at 0.5 mm. The rapid quenching atmosphere was Ar gas at a pressure of 50 kPa. The Ar gas used had a differential pressure of 50 kPa to eject the melt strongly enough.

Figure 2:
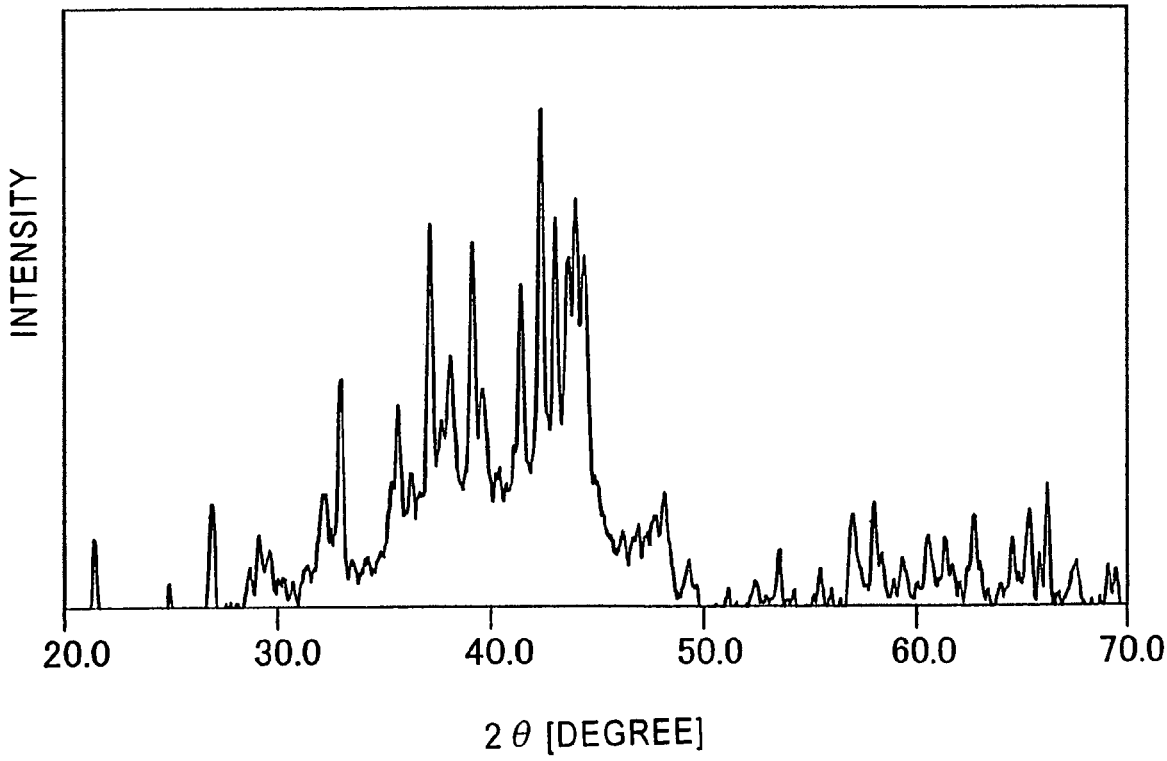
FIG. 2 is a graph showing the XRD pattern of a rapidly solidified thin strip of mother alloy E yet to be thermally treated and crystallized, in which the abscissa represents the diffraction angle (2θ) and the ordinate represents the diffraction peak intensity.
Figure 3:
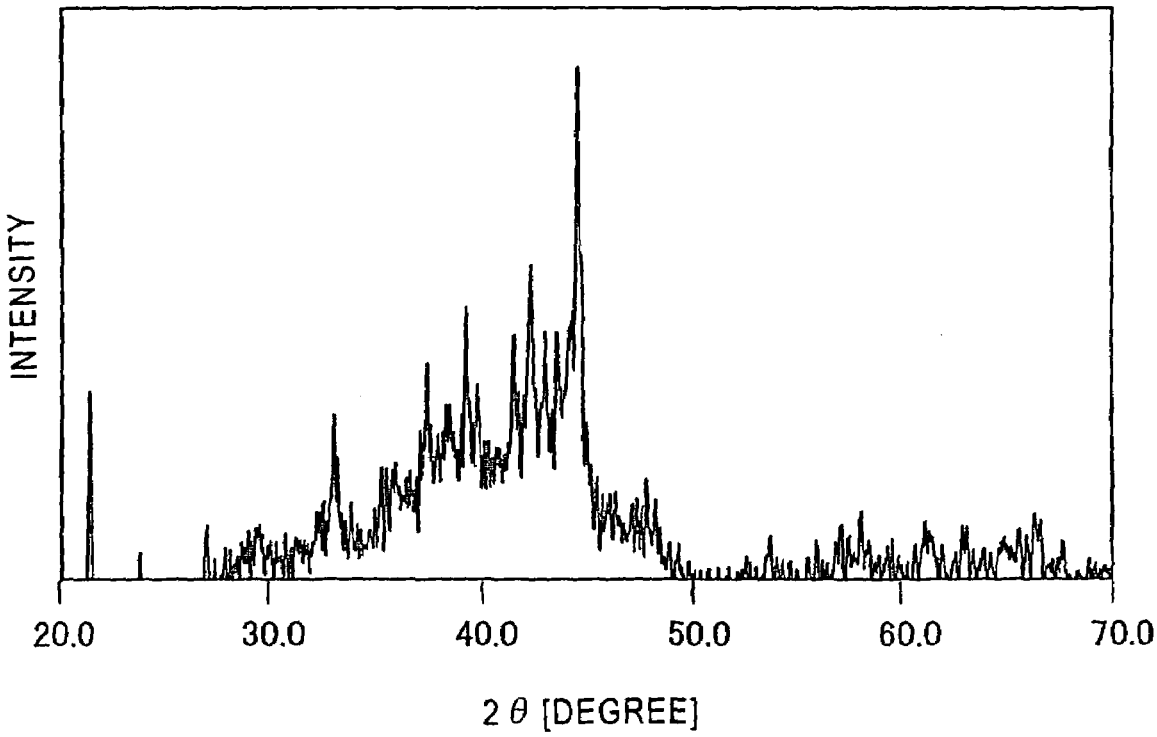
FIG. 3 is a graph showing the XRD pattern of a rapidly solidified thin strip of mother alloy G yet to be thermally treated and crystallized, in which the abscissa represents the diffraction angle (2θ) and the ordinate represents the diffraction peak intensity.

FIGS. 2 and 3 are graphs each showing the XRD pattern of a rapidly solidified thin strip, which was measured with a CuKα radiation source before being thermally treated and crystallized. The abscissa represents the diffraction angle 2θ and the ordinate represents the diffraction intensity. Specifically, FIG. 2 relates to a comparative example in which mother alloy E including no additive carbon (C) was used, while FIG. 3 relates to an example of the present invention in which mother alloy G including an appropriate amount of carbon was used.

Each of the rapidly solidified alloy thin strips obtained by the rapid quenching process included a lot of crystalline phases as can be seen from XRD data shown in FIGS. 2 and 3, and had a coercivity $H_{cJ}$ of 100 kA/m or less.

Such a rapidly solidified alloy thin strip was pulverized with an agate mortar to a size of 500 μm or less, and then subjected to a heat treatment process for crystallization so as to be maintained at a temperature of 500° C. to 1,000° C. for 30 minutes within an Ar atmosphere. The thermally treated powders were subjected to magnetic property evaluation with a VSM and X-ray diffraction analysis. The results are shown in the following Table 2:

TABLE 2

| No. | Mother Alloy | Heat Treatment Temperature (° C.) | Magnetic Properties Br (T) | Magnetic Properties HcJ (kA/m) | Diffraction around d = 0.298 nm |
|---|---|---|---|---|---|
| 1 | B | 600 | 0.90 | 890 | ○ |
| 2 | D | 600 | 0.88 | 1140 | ○ |
| 3 | F | 560 | 0.77 | >1200 | ◎ |
| 4 | F | 610 | 0.78 | >1200 | ◎ |
| 5 | F | 650 | 0.76 | 1170 | ◎ |
| 6 | F | 700 | 0.73 | 1030 | ◎ |
| 7 | G | 570 | 0.74 | >1200 | ◎ |
| 8 | G | 600 | 0.71 | >1200 | ◎ |
| 9 | H | 580 | 0.74 | >1200 | ◎ |
| 10 | H | 620 | 0.70 | 1190 | ◎ |
| 11 | H | 700 | 0.70 | 1050 | ◎ |
| 12 | J | 570 | 0.78 | >1200 | ◎ |
| 13 | J | 650 | 0.79 | >1200 | ◎ |
| 14 | K | 610 | 0.79 | >1200 | ◎ |
| 15 | L | 610 | 0.76 | >1200 | ◎ |
| 16 | M | 600 | 0.72 | >1200 | ◎ |
| 17 | N | 600 | 0.70 | >1200 | ◎ |
| 18 | N | 700 | 0.68 | >1200 | ◎ |
| 19 | C | 600 | 0.78 | 470 | Δ |
| 20 | A | 600 | 0.67 | 180 | X |
| 21 | O | 600 | 0.61 | >1200 | ◎ |
| 22 | E | 600 | 0.73 | >1200 | X |
| 23 | I | 600 | 0.50 | 150 | X |
| 24 | G | 500 | 0.42 | 120 | X |
| 25 | G | 800 | 0.35 | 210 | Δ |

Table 2 shows the sign of the mother alloy used, heat treatment temperature, magnetic properties (such as remanence $B_r$ and coercivity $H_{cJ}$) and presence or absence of a diffraction peak around d=0.298 nm (i.e., in the vicinity of 2θ=30.0 degrees) for each sample. On the rightmost column of Table 2, the double circle ◎ indicates that a diffraction peak, of which the intensity was 80% or more of that of the $R_2Fe_{14}B$ type crystalline phase representing a (410) plane (2θ=42.2 degrees), was observed around d=0.298 nm (i.e., in the vicinity of 2 θ=30.0 degrees). The single circle ○ indicates that a diffraction peak, of which the intensity was 10% or more of that diffraction peak (2θ=42.2 degrees), was observed around d=0.298 nm (i.e., in the vicinity of 2θ=30.0 degrees). The open triangle Δ indicates that a diffraction peak, of which the intensity was 5% to 10% of that diffraction peak (2θ=42.2 degrees), was observed around d=0.298 nm (i.e., in the vicinity of 2θ=30.0 degrees). And the cross × indicates that no diffraction peaks were observed around d=0.298 nm.

As can be seen from Table 2, when a diffraction peak with a sufficient intensity was observed around d=0.298 nm, excellent magnetic properties were achieved. On the other hand, if a rapidly solidified alloy was made from the melt of mother alloy E, to which no carbon was added at all, substantially no second compound phase was produced and its diffraction peak was not observed around d=0.298 nm even when the alloy was heated and crystallized at 600° C. after that.

Also, even if a rapidly solidified alloy was made from mother alloy G with an appropriate composition, no diffraction peaks of the second compound phase were observed around d=0.298 nm and the magnetic properties were bad when the heat treatment for crystallization was conducted at a temperature of 500° C. or less or at a temperature of 800° C. or more.

Figure 4:
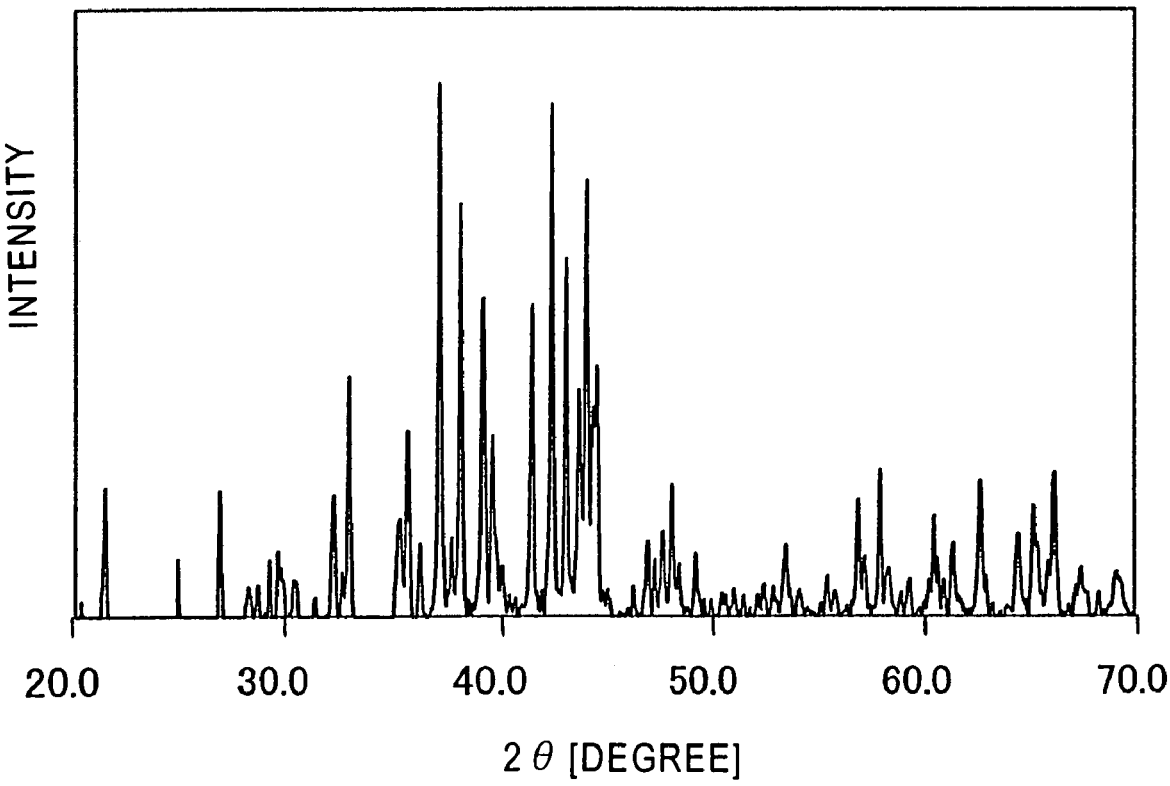
FIG. 4 is a graph showing the XRD pattern of a thermally treated and crystallized alloy as Sample No. 22, in which the abscissa represents the diffraction angle (2θ) and the ordinate represents the diffraction peak intensity.
Figure 5:
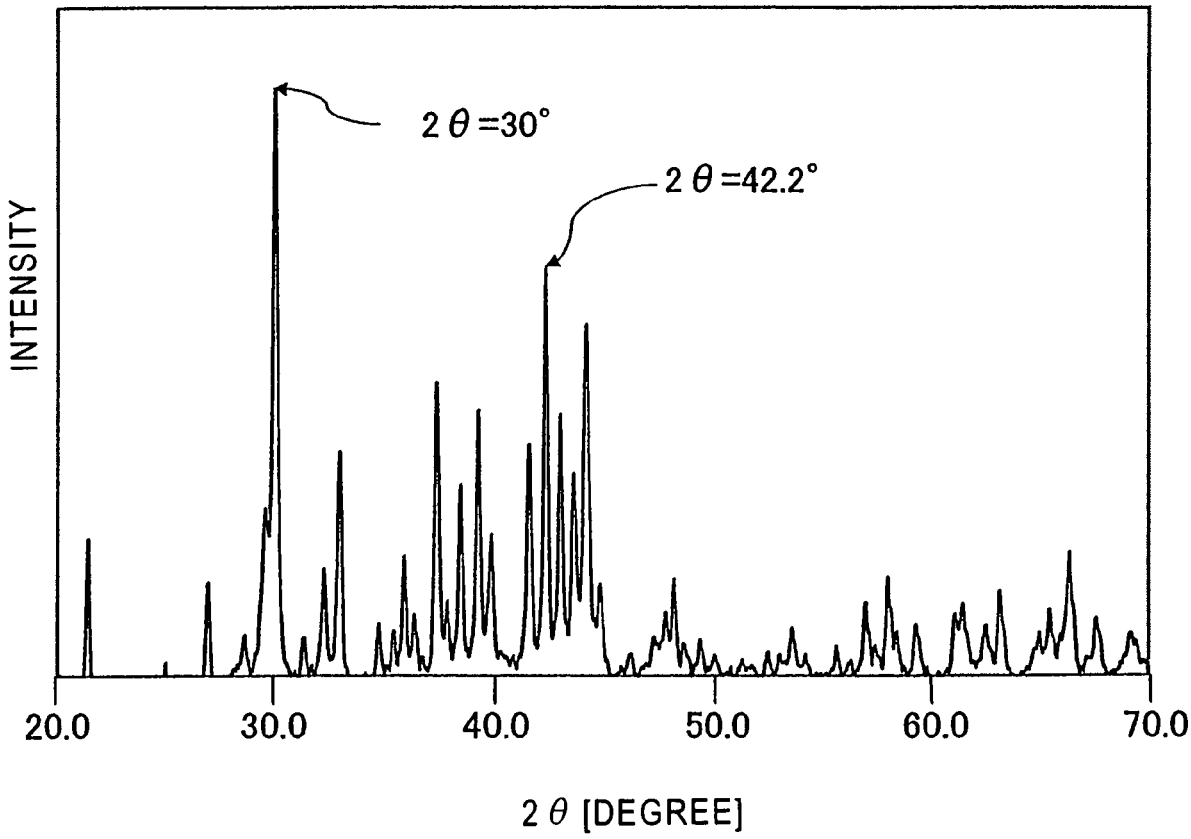
FIG. 5 is a graph showing the XRD pattern of a thermally treated and crystallized alloy as Sample No. 8, in which the abscissa represents the diffraction angle (2θ) and the ordinate represents the diffraction peak intensity.

FIGS. 4 and 5 are graphs each showing the XRD pattern of the rapidly solidified thin strip that was already subjected to the heat treatment for crystallization. Specifically, FIG. 4 relates to Sample No. 22 as a comparative example in which mother alloy E including no additive carbon (C) was used, while FIG. 5 relates to Sample No. 8 as an example of the present invention in which mother alloy G including an appropriate amount of carbon was used.

As can be seen from FIG. 5, in addition to a peak representing the $R_2Fe_{14}B$ type compound with hard magnetic properties, another diffraction peak was clearly observed in Sample No. 8 at a site with an interplanar spacing d of 0.295 nm to 0.300 nm (i.e., around d=0.298 nm: 2θ=30.0 degrees). In FIG. 4 on the other hand, no diffraction peaks were observed around the interplanar spacing d=0.298 nm (i.e., in the vicinity of 2θ=30.0 degrees).

In FIG. 5, the intensity ratio of the diffraction peak of the second compound phase (i.e., in the vicinity of 2θ=30.0 degrees) to that of the $R_2Fe_{14}B$ type crystalline phase representing a (410) plane (i.e., 2θ=42.2 degrees) was 100% or more.

Next, the relationship between the carbon (C) ratio X to the sum of boron (B) and carbon (C) and the magnetic properties will be described with reference to FIGS. 6 through 9.

Figure 6:
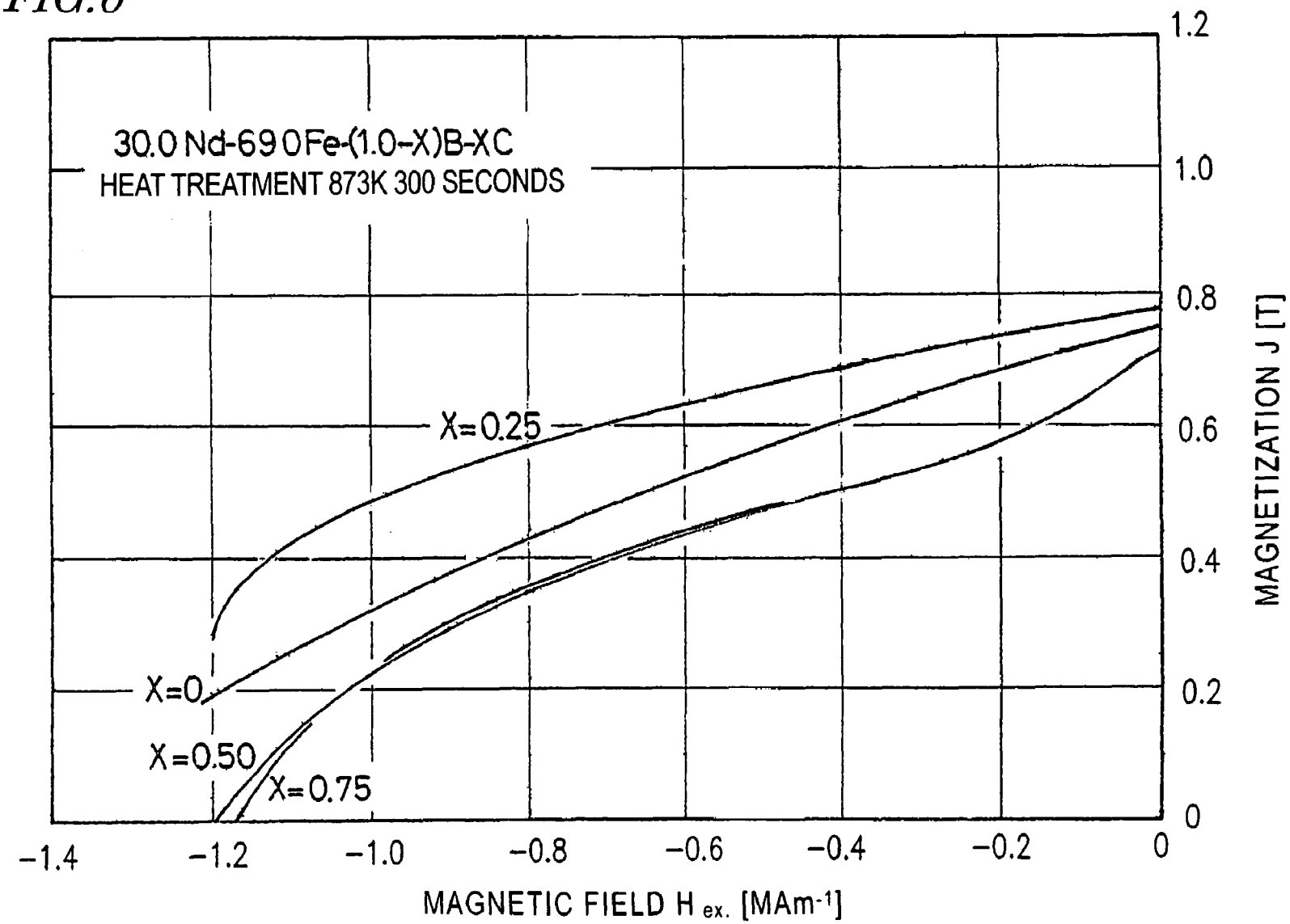
FIG. 6 is a graph showing how the magnetic properties of an R-T-B-C based rare-earth alloy magnetic material represented by the formula $Nd_{30.0}Fe_{69.0}B_{(1.0-X)}C_X$ (and thermally treated at 873 K for 300 seconds) changed with the carbon ratio X that fell within the range of 0 to 0.75.

FIG. 6 shows how the magnetic properties of an R-T-B-C based rare-earth alloy magnetic material represented by the formula $Nd_{30.0}Fe_{69.0}B_{(1.0-X)}C_X$ changed with the carbon ratio X that fell within the range of 0 to 0.75. In this case, the magnetic material was thermally treated at 873 K for 300 seconds. In FIG. 6, the abscissa represents the external magnetic field $H_{ex}$ in MA/n and the ordinate represents the magnetization J in tesla (T). As can be seen from FIG. 6, the best magnetic properties were achieved when X=0.25 and were better than the magnetic material to which no carbon was added at all.

Figure 7:
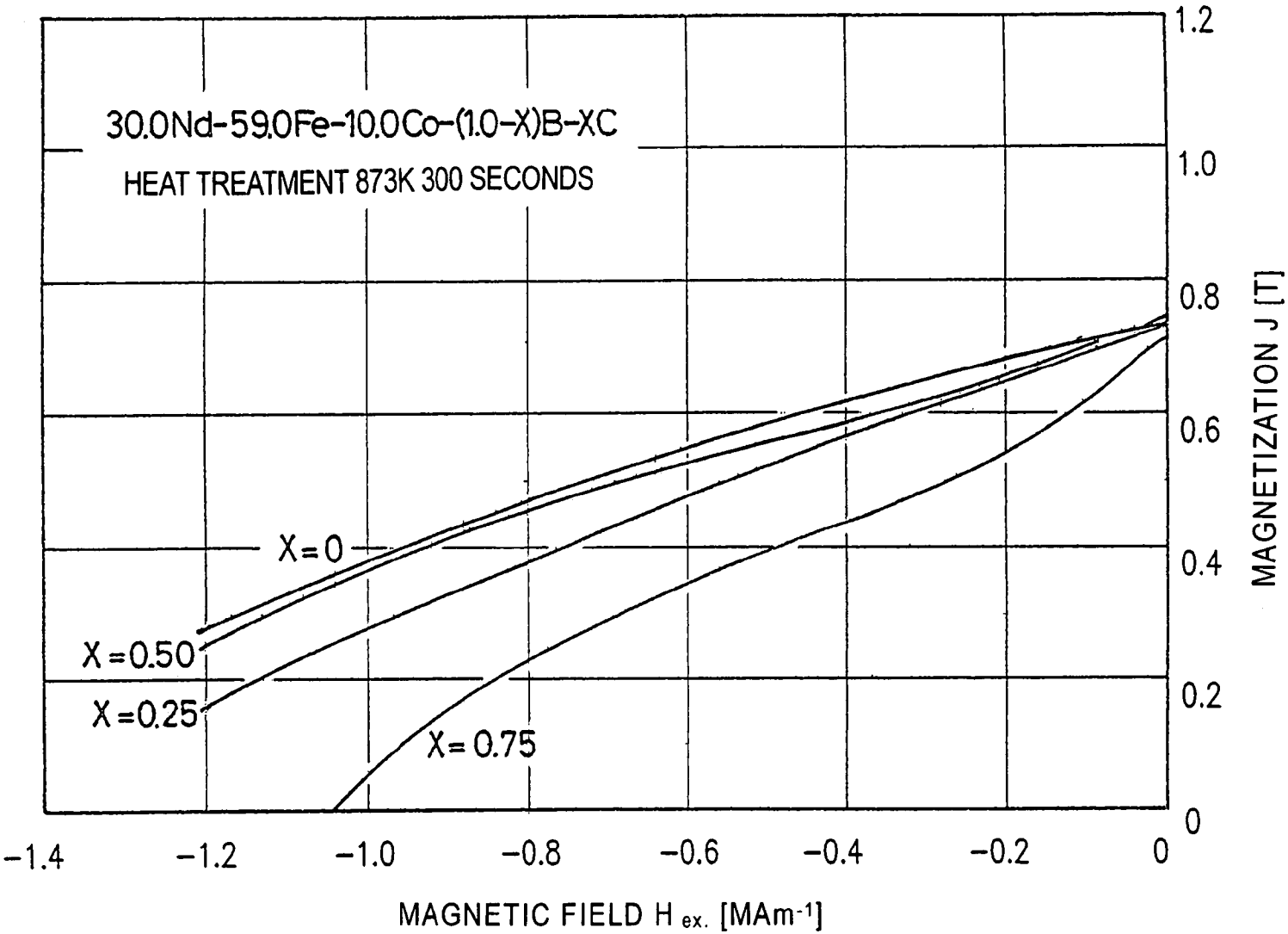
FIG. 7 is a graph similar to FIG. 6 and shows how the magnetic properties of an R-T-B-C based rare-earth alloy magnetic material represented by the formula $Nd_{30.0}Fe_{59.0}Co_{10.0}B_{(1.0-X)}C_X$ (and thermally treated at 873 K for 300 seconds) changed with the carbon ratio X that fell within the range of 0 to 0.75.

FIG. 7 is a graph similar to FIG. 6 and shows how the magnetic properties of an R-T-B-C based rare-earth alloy magnetic material represented by the formula $Nd_{30.0}Fe_{59.0}Co_{10.0}B_{(1.0-X)}C_X$ changed with the carbon ratio X that fell within the range of 0 to 0.75. In this case, the magnetic material was also thermally treated at 873 K for 300 seconds. As can be seen from FIG. 7, sufficiently good magnetic properties were achieved in the X range of 0.25 to 0.75.

Figure 8:
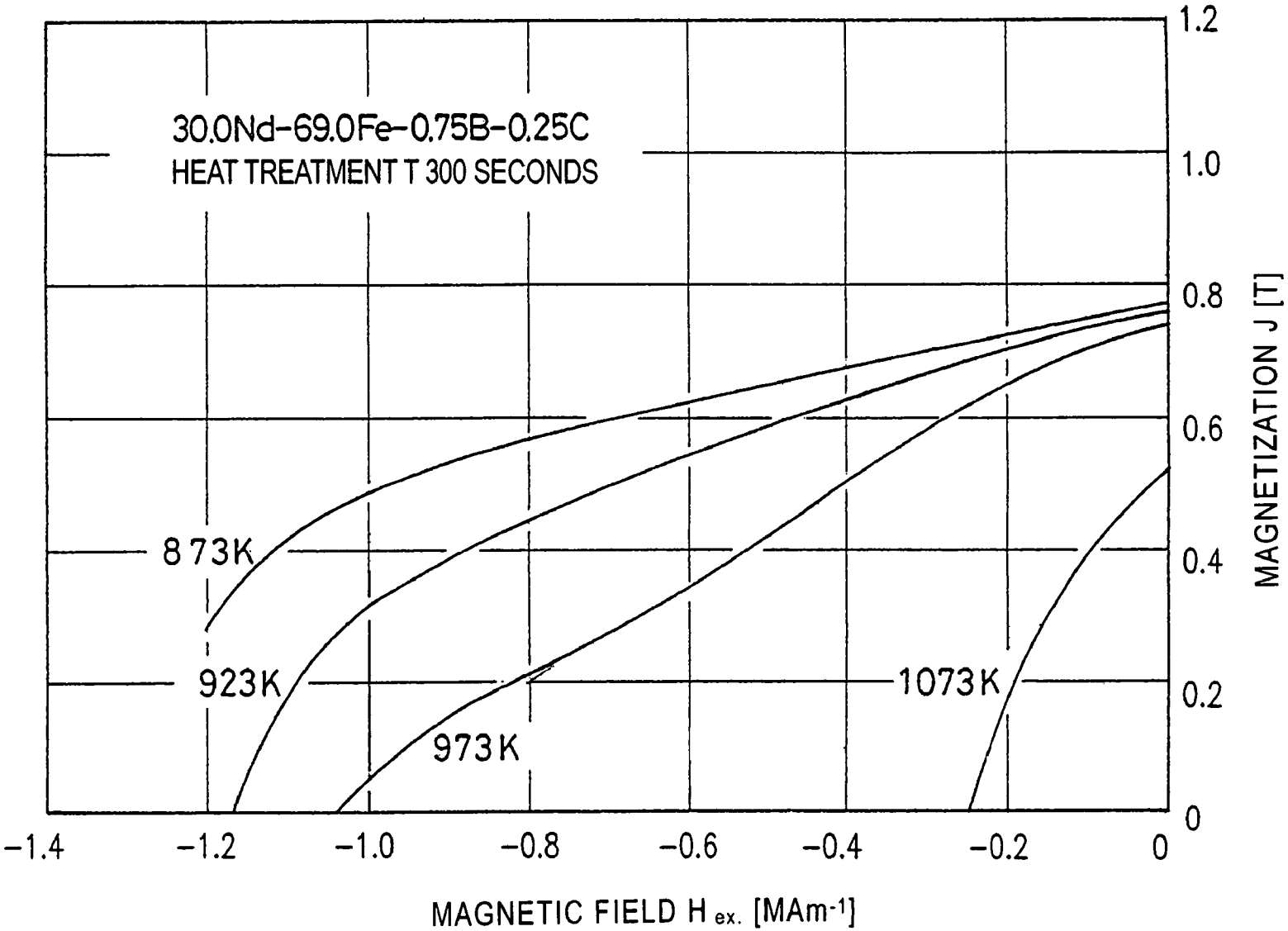
FIG. 8 is a graph showing how the magnetic properties of an R-T-B-C based rare-earth alloy magnetic material represented by the formula $Nd_{30.0}Fe_{69.0}B_{0.75}C_{0.25}$ changed with the heat treatment temperature T that fell within the range of 873 K to 1,073 K (i.e., 600° C. to 800° C.).

FIG. 8 shows how the magnetic properties of an R-T-B-C based rare-earth alloy magnetic material represented by the formula $Nd_{30.0}Fe_{69.0}B_{0.75}C_{0.25}$ changed with the heat treatment temperature T that fell within the range of 873 K to 1,073 K (i.e., 600° C. to 800° C.). As can be seen from FIG. 8, the magnetic properties deteriorated when the heat treatment temperature was 1,073 K (or 800° C.).

Figure 9:
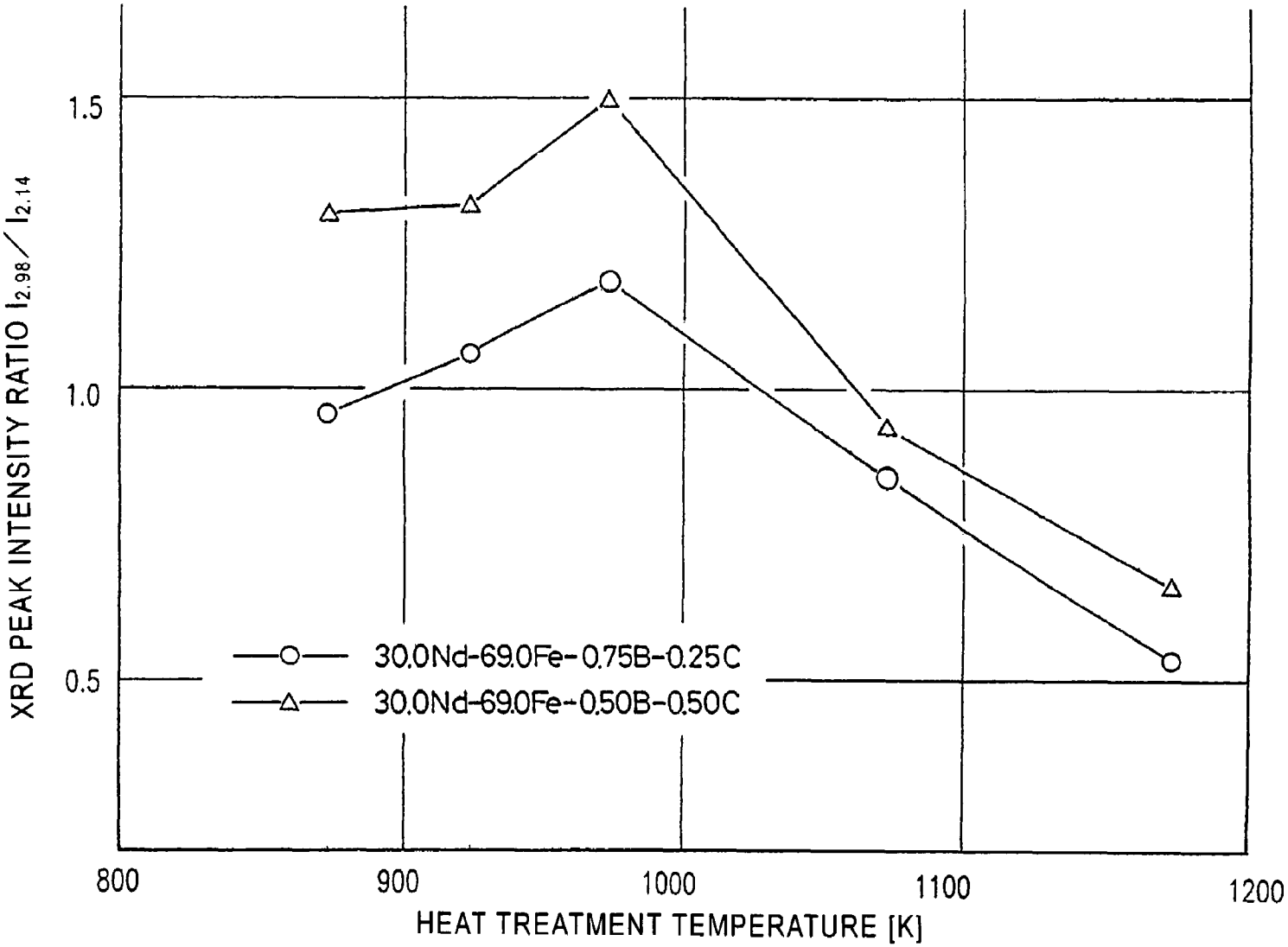
FIG. 9 is a graph showing how the peak intensity ratio of an R-T-B-C based rare-earth alloy magnetic material represented by either $Nd_{30.0}Fe_{69.0}B_{0.75}C_{0.25}$ or $Nd_{30.0}Fe_{69.0}B_{0.50}C_{0.50}$ changed with the heat treatment temperature T falling within a broad range.

FIG. 9 shows how the peak intensity ratio of an R-T-B-C based rare-earth alloy magnetic material represented by either $Nd_{30.0}Fe_{69.0}B_{0.75}C_{0.25}$ or $Nd_{30.0}Fe_{69.0}B_{0.50}C_{0.50}$ changed with a heat treatment temperature T falling within a broad range. As can be seen from FIG. 9, the ratio ($I_{2.98}/I_{2.14}$) of the diffraction peak intensity $I_{2.98}$ of the second compound phase (around 2θ=30.0 degrees) to the diffraction peak intensity $I_{2.14}$ of the $R_2Fe_{14}B$ type crystalline phase representing a (410) plane was the highest when the heat treatment temperature was about 973 K (or 700° C.).

INDUSTRIAL APPLICABILITY

According to the present invention, an R-T-B-C based rare-earth alloy magnetic material, including carbon (C) but exhibiting excellent magnetic properties, is provided. Thus, no matter whether the collected rare-earth magnet is a sintered magnet or a bonded magnet, the collected magnet can be recycled into a magnetic material (in the form of thin strip or powder). As a result, valuable natural resources can be used more effectively and the manufacturing cost of magnets can be reduced significantly.

In addition, the additive carbon decreases the oxidation reactivity of the rare-earth magnet. Thus, the magnet performance will not deteriorate due to heat generation or ignition during the manufacturing process or the safety of the manufacturing process will not be endangered. Furthermore, the deterioration of the magnet with time can be minimized even without providing any special protective coating on the surface of the magnet to improve the weather resistance thereof.

The invention claimed is:

1. An R-T-B-C based rare-earth alloy magnetic material (where R is at least one of the rare-earth elements including Y, T is a transition metal including iron as its main ingredient, B is boron, and C is carbon, an amount of R being 25 wt % to 35 wt % of the overall magnetic material, a total amount of B and C being 0.9 wt % to 1.1 wt % of the magnetic material, the balance of the magnetic material being T) comprising:

a first compound phase with an $R_2Fe_{14}B$ type crystal structure, and a second compound phase having a diffraction peak at a site with an interplanar spacing d of 0.295 nm to 0.300 nm, wherein the first compound phase is a main phase and an intensity ratio of the diffraction peak of the second compound phase to that of the first compound phase representing a (410) plane (and having an interplanar spacing of 0.214 nm) is at least 10%.

2. The R-T-B-C based rare-earth alloy magnetic material of claim 1, wherein the ratio of the content of C (carbon) to the total content of B (boron) and C is 0.05 to 0.75.

3. The R-T-B-C based rare-earth alloy magnetic material of claim 1, wherein the first compound phase has an average grain size of 10 nm to 500 nm.

4. The R-T-B-C based rare-earth alloy magnetic material of claim 1, wherein the magnetic material is obtained by a method including the steps of: making a rapidly solidified alloy by rapidly quenching a melt of an R-T-B-C based rare-earth alloy; and thermally treating and crystallizing the rapidly solidified alloy.

5. The R-T-B-C based rare-earth alloy magnetic material of claim 1, wherein a portion of Fe included in T is replaced with at least one element selected from the group consisting of Co, Ni, Mn, Cr and Al.

6. The R-T-B-C based rare-earth alloy magnetic material of claim 1, further comprising, as an additive, at least one element selected from the group consisting of Si, P, Cu, Sn, Ti, Zr, V, Nb, Mo and Ga.

7. A rare-earth alloy magnetic powder obtained by pulverizing the R-T-B-C based rare-earth alloy magnetic material of claim 1.

8. A bonded magnet produced by processing the rare-earth alloy magnetic powder of claim 4.

9. A permanent magnet produced by processing the rare-earth alloy magnetic powder of claim 7.

10. A method of making an R-T-B-C based rare-earth alloy magnetic material, the method comprising the steps of:

preparing a rapidly solidified alloy by rapidly quenching a melt of an R-T-B-C based rare-earth alloy (where R is at least one of the rare-earth elements including Y, T is a transition metal including iron as its main ingredient, B is boron, and C is carbon, an amount of R being 25 wt % to 35 wt % of the overall magnetic material, a total amount of B and C being 0.9 wt % to 1.1 wt % of the magnetic material, the balance of the magnetic material being T); and thermally treating and crystallizing the rapidly solidified alloy, wherein the step of thermally treating results in producing a first compound phase with an $R_2Fe_{14}B$ type crystal structure and a second compound phase having a diffraction peak at a site with an interplanar spacing d of 0.295 nm to 0.300 nm, and wherein the first compound phase is a main phase and an intensity ratio of the diffraction peak of the second compound phase to that of the first compound phase representing a (410) plane is at least 10%.

11. A method of making an R-T-B-C based rare-earth alloy magnetic material, the method comprising the step of obtaining the R-T-B-C based rare-earth alloy magnetic material, including a first compound phase with an $R_2Fe_{14}B$ type crystal structure and a second compound phase having a diffraction peak at a site with an interplanar spacing d of 0.295 nm to 0.300 nm, by rapidly quenching a melt of an R-T-B-C based rare-earth alloy (where R is at least one of the rare-earth elements including Y, T is a transition metal including iron as its main ingredient, B is boron, and C is carbon, an amount of R being 25 wt % to 35 wt % of the overall magnetic material, a total amount of B and C being 0.9 wt % to 1.1 wt % of the magnetic material, the balance of the magnetic material being T), wherein the first compound phase is a main phase and an intensity ratio of the diffraction peak of the second compound phase to that of the first compound phase representing a (410) plane is at least 10%.

12. The method of claim 10, further comprising a pulverizing process step before and/or after the step of thermally treating.

13. A method for producing a bonded magnet, the method comprising the steps of:

preparing a powder of the R-T-B-C based rare-earth alloy magnetic material that has been obtained by the method of one of claims 10 to 12; and compounding the powder and a binder material together and molding the compound.

14. A method of making an R-T-B-C based rare-earth alloy magnetic material, the method comprising the steps of:

preparing an R-T-B-C based rare-earth rapidly solidified alloy (where R is at least one of the rare-earth elements including Y, T is a transition metal including iron as its main ingredient, B is boron, and C is carbon, an amount of R being 25 wt % to 35 wt % of the overall magnetic material, a total amount of B and C being 0.9 wt % to 1.1 wt % of the magnetic material, the balance of the magnetic material being T) by melting and rapidly quenching and solidifying a collected and used R-T-B based rare-earth magnet; and thermally treating and crystallizing the R-T-B-C based rare-earth rapidly solidified alloy.

15. The method of claim 14, wherein the step of thermally treating results in producing a first compound phase with an $R_2Fe_{14}B$ type crystal structure and a second compound phase having a diffraction peak at a site with an interplanar spacing d of 0.295 nm to 0.300 nm, and wherein an intensity ratio of the diffraction peak of the second compound phase to that of the first compound phase representing a (410) plane is at least 10%.

16. A method for producing a bonded magnet, the method comprising the steps of:

preparing a powder of the R-T-B-C based rare-earth alloy magnetic material that has been obtained by the method of claim 14 or 15; and compounding the powder and a binder material together and molding the compound.

* * * * *